US009781983B2

(12) United States Patent
Vaillancourt et al.

(10) Patent No.: US 9,781,983 B2
(45) Date of Patent: Oct. 10, 2017

(54) STRAND JEWELRY DEVICE

(71) Applicants: Michael J. Vaillancourt, Chester, NJ (US); Kathryn E. Vaillancourt, Chester, NJ (US); Theresa E. Vaillancourt, Chester, NJ (US)

(72) Inventors: Michael J. Vaillancourt, Chester, NJ (US); Kathryn E. Vaillancourt, Chester, NJ (US); Theresa E. Vaillancourt, Chester, NJ (US)

( * ) Notice: Subject to any disclaimer, the term of this patent is extended or adjusted under 35 U.S.C. 154(b) by 19 days.

(21) Appl. No.: 14/747,175

(22) Filed: Jun. 23, 2015

(65) Prior Publication Data

US 2015/0366302 A1 Dec. 24, 2015

Related U.S. Application Data

(60) Provisional application No. 62/015,840, filed on Jun. 23, 2014.

(51) Int. Cl.
*A44C 5/02* (2006.01)
*A44C 11/00* (2006.01)

(52) U.S. Cl.
CPC ..... *A44C 5/022* (2013.01); *A44C 11/00* (2013.01)

(58) Field of Classification Search
CPC ..... A44C 11/00; A44C 11/02; A44C 5/022; A44C 5/00
USPC ..... 63/3, 3.1
See application file for complete search history.

(56) References Cited

U.S. PATENT DOCUMENTS 1,510,421 A * 9/1924 Sherman ..... A44C 11/002 63/3.1
1,525,005 A * 2/1925 Sherman ..... A44C 5/00 235/123

* cited by examiner

*Primary Examiner* — Abigail Troy
(74) *Attorney, Agent, or Firm* — Francis C. Hand; Carella, Byrne et al

(57) ABSTRACT

A bracelet 10 comprised of multiple strands has at least one bridge, for example three bridges, slidably disposed on the strands to connect the strands in spaced apart relation to prevent entwining of the strands with each other. Each bridge has a pair of bodies of toric shape connected by a rigid bar and each bridge may be shaped and/or colored to lend aesthetic value to the appearance of the bracelet.

11 Claims, 3 Drawing Sheets

STRAND JEWELRY DEVICE

This application claims priority of Provisional Patent Application 62/015,840, filed Jun. 23, 2014.

This invention relates to a strand jewelry device. More particularly, this invention relates to a strand jewelry device in the form of a bracelet or a necklace.

Strand jewelry devices have been know, such as described in U.S. Pat. No. 7,007,507, wherein beads may be located on an endless strand and maintained in place by keepers that are also slidably mounted on the strand or fixed in place on the strand.

Strand jewelry devices may be used as bracelets or necklaces. In many instances, a user may wear multiple bracelets and/ or necklaces. In such cases, the individual bracelets or necklaces can become entwined in use. This may lead to difficulties in removing the bracelets or necklaces from the person when there is no longer a need to display the jewelry devices.

It is an object of this invention to avoid entwining of multiple strands of stranded jewelry on a wearer.

It is another object of the invention to provide a simple means for maintaining multiple strands of stranded jewelry on a wearer in a separated condition without entwining.

It is another object of the invention to avoid entwining of multiple bracelets on a wearer.

It is another object of the invention to avoid entwining of multiple necklaces on a wearer.

It is another object of the invention to provide a simple means for maintaining multiple strands of stranded jewelry on a wearer in a separated condition while providing an attractive appearance.

Briefly, the invention is directed to a strand jewelry device comprised of at least a pair of strands with beads and keepers on each strand.

In accordance with the invention, at least one bridge is slidably disposed on and between the strands to connect the strands in spaced apart relation. The bridge serves not only to maintain a spacing between the strands off beads but also allows the strands to be handled as a unit.

The bridges may be constructed to maintain a three or more strands of beads in spaced apart parallel relation.

Figure 1:
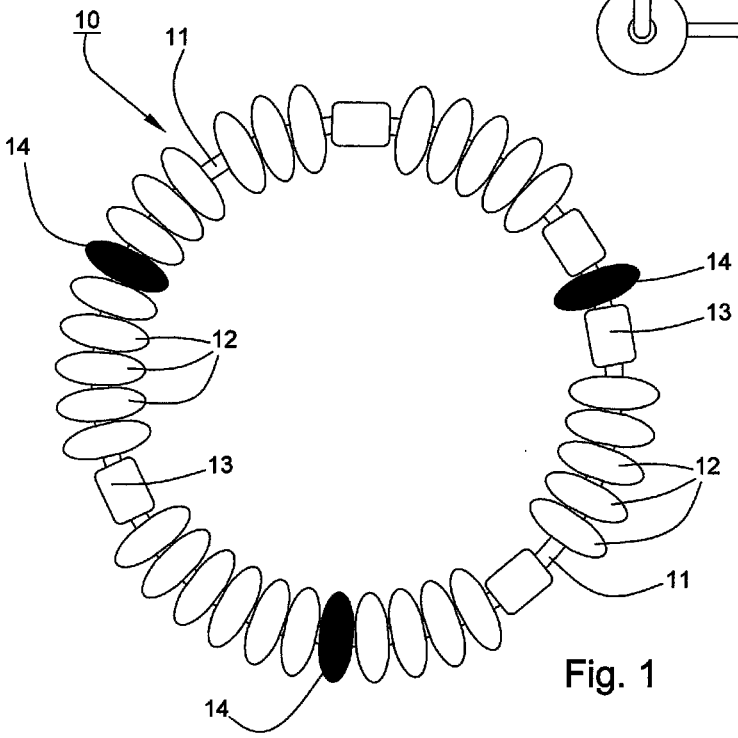
FIG. 1 illustrates a strand jewelry device of the invention in the form of a bracelet.

Referring to FIG. 1, the strand jewelry device 10 is in the form of a bracelet, for example, of a size to be slid onto the wrist or arm of a user.

Figure 2:
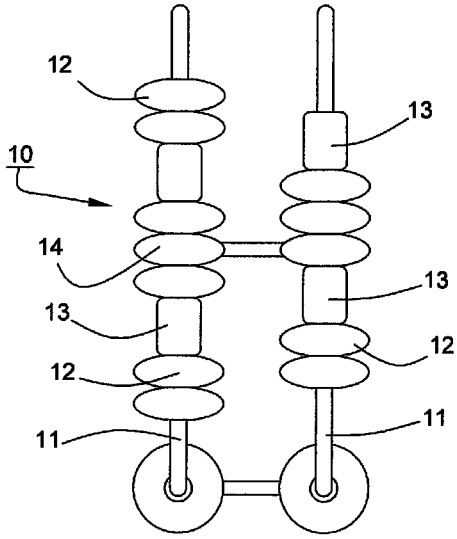
FIG. 2 illustrates a side view of the strand jewelry device of FIG. 1.

The bracelet 10 is comprised of multiple strands 11. For purposes of simplicity, FIGS. 1 and 2 illustrate a bracelet 10 formed of a pair of strands 11.

Each strand 11 of the bracelet 10 has a series of beads 12 slidably disposed thereon. These beads 12 may be of any conventional shape and type as commonly used on strand jewelry devices.

Each strand 11 also has at least one keeper 13 on each strand interposed with the beads 12. The use of keepers 13 is conventional. The keepers 13 may be slidably mounted on the strands 11 or may be fixed in place as is known.

The bracelet 10 also has at least one bridge 14, for example three bridges in the illustrated embodiment, slidably disposed on the strands 11 to connect the strands 11 in spaced apart relation.

Figure 3:
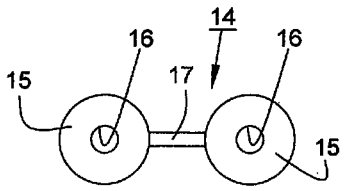
FIG. 3 illustrates a top view of a bridge employed in the jewelry device of FIG. 1.
Figure 4:
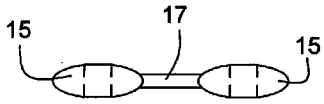
FIG. 4 illustrates a side view of the bridge of FIG. 3.

Referring to FIGS. 3 and 4, each bridge 14 has a pair of bodies 15, each of toric shape and each with a central bore 16 to receive and be slidably disposed on a respective strand 11 of the bracelet 10 as indicated in FIG. 2. Each bridge 14 also has a rigid bar 17 connecting the bodies 15. The bar 17 is integral with the two bodies 15 to form a one-piece member.

Referring to FIGS. 1 and 2, each bridge 14 is slid onto the two strands 11 of the bracelet 10 in interposed relation to the beads 12, for example adjacent to a keeper 13 in order to hold the two strands apart to prevent entwining of the strands 11 together during use. The bridges 14 also allow the bracelet 10 to be used as a unit.

Each bridge 14 may be made of a suitable material, such as silver, stainless steel, stone and the like. Further, each body 15 of a bridge 14 may be shaped and/or colored to lend aesthetic value to the appearance of the bracelet 10. Also, the appearance of the bridges 14 used in the bracelet 10 may differ from each other for aesthetic reasons.

The length of the bar 17 of a bridge 14 is such as to maintain a comfortable spacing between the strands 11 of the bracelet but may also be exaggerated to allow multiple strands to be spaced along the arm of a user.

Figure 5:
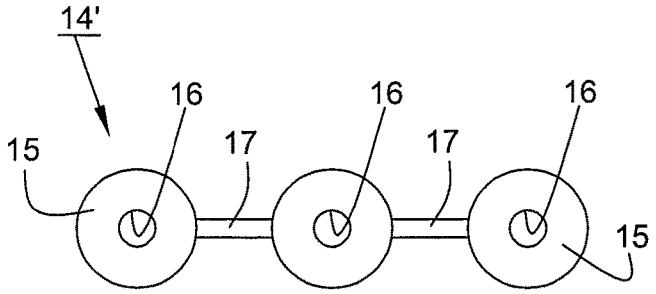
FIG. 5 illustrates a top view of a bridge for maintaining three strands of beads in spaced relation.
Figure 6:
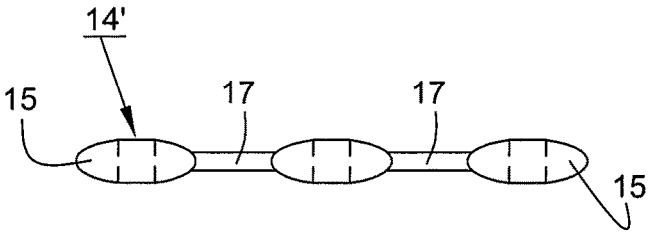
FIG. 6 illustrates a side view of the bridge of FIG. 5.

Referring to FIGS. 5 and 6, wherein like reference characters indicate like parts as above, a bridge 14' may be formed with three bodies 15, each of toric shape and with a central bore 16 to receive and be slidably disposed on a respective strand of a bracelet (not shown). As above, each two bodies 15 are interconnected to each other by a bar 17.

Figure 7:
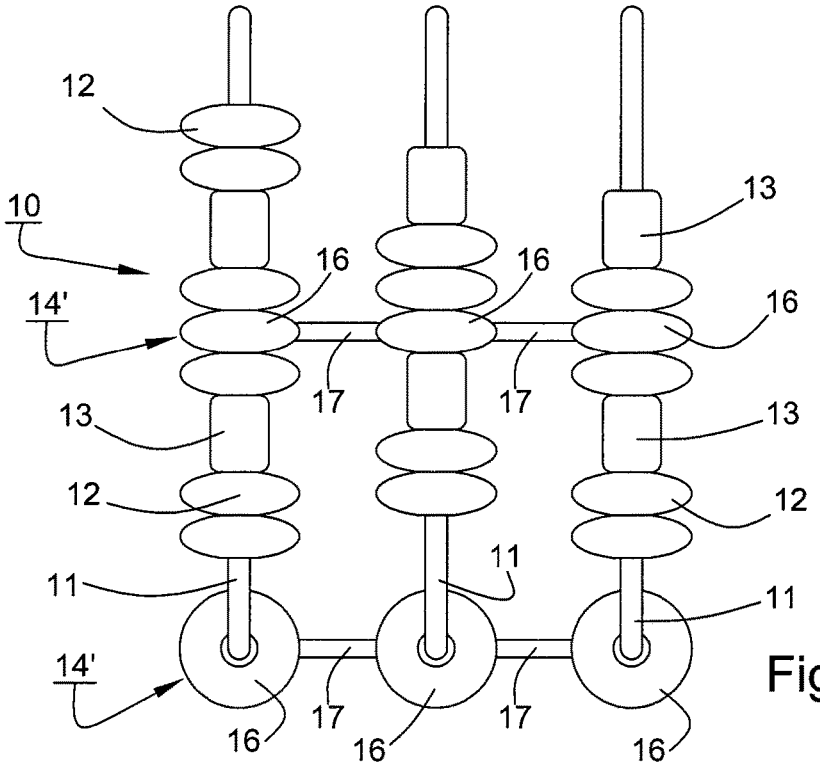
FIG. 7 illustrates a side view of a three strand jewelry device employing the bridge of FIGS. 5 and 6.

Referring to FIG. 7, wherein like reference characters indicate like parts as above, a jewelry device may be made with three strands 11 separated by multiple bridges 14'.

Figure 8:
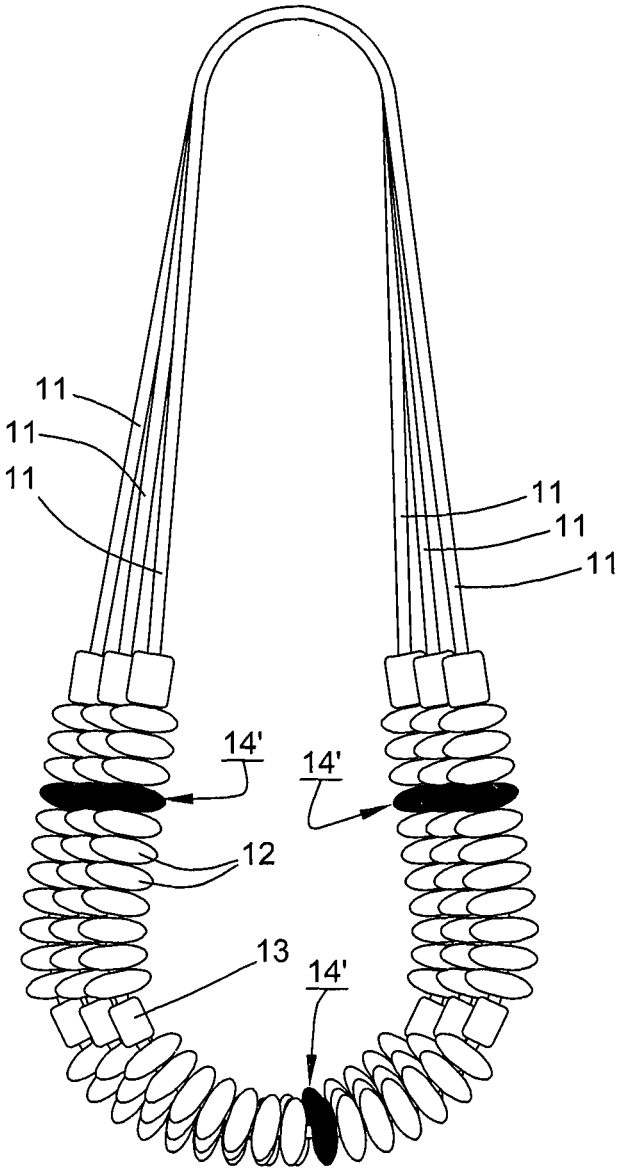
FIG. 8 illustrates a necklace employing three strands in accordance with the invention .

The strand jewelry device may also be made in the form of a necklace as shown in FIG. 8 wherein the strands 11 are disposed one within the other.

The bar 17 connecting two bodies 15 to each other may be articulated to one or both of the bodies 15 to allow a pivoting or swiveling of the bar 17 relative to a body 15. This would allow two strands of beads 12 to move towards each other by rotating one strand relative to the other.

The invention thus provides a simple means for maintaining multiple strands of stranded jewelry on a wearer in a separated condition without entwining.

What is claimed is:

1. A strand jewelry device comprising at least a pair of strands;

a first series of beads slidably disposed on one strand of said at least a pair of strands;

a second series of beads slidably disposed on a second strand of said at least a pair of strands;

a first plurality of keepers on said one strand interposed with said first series of beads, each said keeper being disposed between two of said beads of said first series of beads;

a second plurality of keepers on said second strand interposed with said second series of beads; and at least one bridge slidably disposed on said one strand and said second strand to connect said one strand with said second strand in spaced apart relation, said at least one bridge having a first body with a central bore slidably disposed on said one strand, a second body with a central bore slidably disposed on said second strand and a rigid bar connecting said first body and said second body.

2. The strand jewelry device as set forth in claim 1 wherein said bar is integral with said first body and said second body to form a one-piece member.

3. The strand jewelry device as set forth in claim 1 wherein said at least a pair of strands are disposed coaxially of each other to form a bracelet.

4. The strand jewelry device as set forth in claim 1 wherein said first body is of toric shape and said second body is of toric shape.

5. The strand jewelry device as set forth in claim 1 wherein said bar is articulated with said first body and said second body to allow pivoting of said bar relative to said first body and said second body.

6. A bracelet comprising at least a pair of strands, each said strand defining an endless loop and being disposed in coaxial relation to each other;

a first series of beads slidably disposed on one strand of said at least a pair of strands;

a second series of beads slidably disposed on a second strand of said at least a pair of strands;

a first plurality of keepers on said one strand interposed with said first series of beads, each said keeper being disposed between two of said beads of said first series of beads;

a second plurality of keepers on said second strand interposed with said second series of beads; and at least one bridge slidably disposed on said one strand and said second strand to connect said one strand with said second strand in spaced apart coaxial relation, said at least one bridge having a first body with a central bore slidably disposed on said one strand, a second body with a central bore slidably disposed on said second strand and a rigid bar connecting said first body and said second body.

7. The bracelet as set forth in claim 6 further comprising a plurality of said bridges disposed circumferentially of said one strand and said second strand.

8. The bracelet as set forth in claim 7 wherein said plurality of bridges is equi-spaced on said one strand and on said second strand.

9. The bracelet as set forth in claim 6 wherein said first body is of toric shape and said second body is of toric shape.

10. A strand jewelry device comprising a plurality of strands, each said strand defining an endless loop and being disposed in coaxial relation to each other;

a first series of beads slidably disposed on one strand of said plurality of strands;

a second series of beads slidably disposed on a second strand of said plurality of strands;

a third series of beads slidably disposed on a third strand of said plurality of strands; and a plurality of bridges connecting said plurality of stands in spaced apart coaxial relation, each said bridge having a first shaped body with a central bore receiving and slidably disposed on said one strand, a second shaped body with a central bore receiving and slidably disposed on said second strand, a third shaped body with a central bore receiving and slidably disposed on said third strand, a first bar connecting said first body and said second body and a second bar connecting said second body and said third body.

11. The strand jewelry device as set forth in claim 10 wherein said plurality of strands are disposed coaxially of each other to form a bracelet.

* * * * *